United States Patent [19]

Daley et al.

[11] Patent Number: 4,915,706

[45] Date of Patent: Apr. 10, 1990

[54] COAL-WATER FUEL PRODUCTION

[76] Inventors: Ralph D. Daley, 1267 Baier Ave., Louisville, Ohio 44641; Kevin E. Redinger, 1841 Carriage La., #301, Alliance, Ohio 44601

[21] Appl. No.: 22,560

[22] Filed: Mar. 3, 1987

Related U.S. Application Data

[63] Continuation of Ser. No. 732,550, May 10, 1985, abandoned.

[51] Int. Cl.[4] ..... C10L 1/32

[52] U.S. Cl. ..... 44/51; 44/622; 44/627

[58] Field of Search ..... 44/51, 15 R, 1 R

[56] References Cited

U.S. PATENT DOCUMENTS

| | | | |
|---|---|---|---|
| 4,403,997 | 9/1983 | Poetschke | 44/51 |
| 4,412,843 | 11/1983 | Burgess et al. | 44/51 |
| 4,479,806 | 10/1984 | Funk | 44/51 |
| 4,484,928 | 11/1984 | Keller, Jr. | 41/15 R |
| 4,515,602 | 5/1985 | Keller, Jr. et al. | 44/51 |
| 4,543,104 | 9/1985 | Brown, Jr. et al. | 44/51 |

*Primary Examiner*—William R. Dixon, Jr.
*Assistant Examiner*—Margaret B. Medley

[57] ABSTRACT

A process and apparatus for producing coal-water fuel comprises crushing and primary grinding of the coal to form a liberated granular material, multiple stage froth flotation of the granulated coal to reduce its ash content and pyritic sulfur content. The resulting product from the froth flotation operations is dewatered to yield a product having a selected solids content. A stable slurry is then produced from the product by establishing a selected particle size distribution. Refuse accumulated from the various previous steps is collected, dewatered and the water is clarified for use in the process steps.

22 Claims, 5 Drawing Sheets

COAL-WATER FUEL PRODUCTION

This application is a continuation of application Ser. No. 732,550 filed May 10, 1985 abandoned.

BACKGROUND OF THE INVENTION

The present invention relates to a method and apparatus for producing coal-water fuel (CWF) on a commercial scale which uses a unique application of conventional, commercially available equipment.

Individual unit operations in the invention include coal crushing, rod milling, sieve bend screening, froth flotation, vacuum filtration, refuse dewatering, and ball milling. These have been practiced in the coal preparation and minerals beneficiation industries for many years. The invention also uses a reverse flotation operation.

The size reduction unit operations; crushing, rod milling, and ball milling, are common in mineral processing plants, e.g. copper and molybdenum ore concentration operations. Rod and ball milling are not found in conventional coal beneficiation operations. Current practice is to avoid the production of fine coal, primarily because of the inefficiency of conventional fine coal cleaning operations.

In conventional coal froth flotation, chemical reagents are added to the pulverized coal-water mixture to permit air bubbles to selectively attach to coal particles, causing them to rise to the surface. The particles of mineral matter remain on the bottom of the flotation cell. For reverse flotation, a different chemical reagent package provides for depression (sinking) of the coal particles and selective attachment of air bubbles to particles of liberated pyrite. Thus, pyrite, which is the principal sulfur-containing mineral associated with coal, rises to the surface and can be skimmed off, resulting in a reduction of the sulfur content of the feed stream.

Froth flotation is a commercially proven technique for reducing the ash content of the feed coal. In most conventional coal flotation applications, only ten to twenty percent of the total plant feed is passed through the flotation circuit. In the present invention the entire feed stream may be directed to the flotation circuit depending on coal characteristics. Separation of the flotation feed into coarse and fine streams (split feed) has been demonstrated to improve the performance of the flotation circuit. Several commercial operations do practice split feed flotation, but this is not common. Separate flotation of coarse coal was first performed about 1960 at the pipeline plant of Hanna Coal Company in Cadiz, Ohio. The Kerr McGee Company has also installed split feed flotation for processing 28 mesh×0 raw coal in their newest 1200 TPH preparation plant. Multiple stage or "rougher-cleaner" flotation has been practiced in the coal industry for over 20 years. The first rougher-cleaner circuits in the coal industry in the U.S. were designed and installed in 1963 at three plants of Bethlehem Mines Corporation in Washington County, Pa. The rougher-cleaner flotation circuits were desiged for 60 TPH of 28 mesh×0 coal.

The reverse flotation process has been tested at both the laboratory and pilot plant levels (12 TPH coal feed) on a number of Pennsylvania and West Virginia coals. These tests indicate that 70% to 90% of the pyritic sulfur could be removed by reverse flotation. Much of the early work, beginning in the late 1960's, was supported by the U.S. Bureau of Mines. Technical details of the process are available in the literature. Several individual companies continued this work in privately sponsored research programs.

The use of a vacuum disc filter for dewatering of fine particles is common practice in both coal beneficiation and minerals processing plants. The present invention, however, requires more sophisticated control than commonly found in existing coal cleaning plants. However, such sophisticated control is standard practice in iron ore benefication systems where filter cake moisture is a crucial parameter in the subsequent pelletizing operation.

The final stage in the CWF production process of the present invention, high density ball milling, has been demonstrated at a pilot scale. A 50 to 100 TPD continuous pilot plant located at Kennedy Van Saun Corporation in Danville, Pa., has been in operation since February 1982. The coal-water fuel technology is covered in U.S. Pat. Nos. 4,282,006 and 4,441,887 to Funk.

SUMMARY OF THE INVENTION

The present invention is drawn to a method and apparatus for the production of coal-water fuel (CWF) on a commercial scale and using a unique combination of unit operations which, in and of themselves, are conventional. As noted above, the individual unit operations include coal crushing, rod milling, sieve bend screening, froth flotation, vacuum filtration, refuse dewatering, and ball milling, as well as reverse flotation operation. The operations include the production of fine particles through staged size reduction in the rod and ball mill circuits which is not a common practice in the coal industry. Neither is the complexity in scope of the froth flotation circuit found in this industry. According to the invention the beneficiation circuit is also positioned between the size reduction devices.

Integration of a coal beneficiation circuit in the inventive process provides the capability of reducing the ash and sulfur content of the raw coal. This capability expands the potential supply of acceptable raw coal feedstocks and provides for the possibility of supplying various quality fuels to meet specific customer requirements. The process extends the commonly accepted limitations of conventional coal beneficiation operations. This is possible because the fine grinding required for CWF production also results in liberation of undesirable mineral matter and pyritic sulfur from the raw coal. Production of a coal-water fuel also eliminates the need for thermal drying of the ground coal and the subsequent handling and storage problems associated with fine, dry coal.

Accordingly an object of the present invention is to provide a method and arrangement of existing apparatus for producing a coal-water fuel comprising a crushing and primary grinding step and equipment for liberating undesirable components of the coal, a conventional froth flotation step and equipment for pyrite removal, a dewatering step and equipment for concentrating the solids content, a slurry preparation step and equipment for controlling particle size distribution and a refuse dewatering and water clarification step and equipment. While the individual function circuits remain constant in the various embodiments of the invention, individual items of the equipment can be substituted. Thus in an operating plant, parallel equipment would be installed and process piping arranged so that individual units could be by-passed in the event of equipment failure or for alternative product preparation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
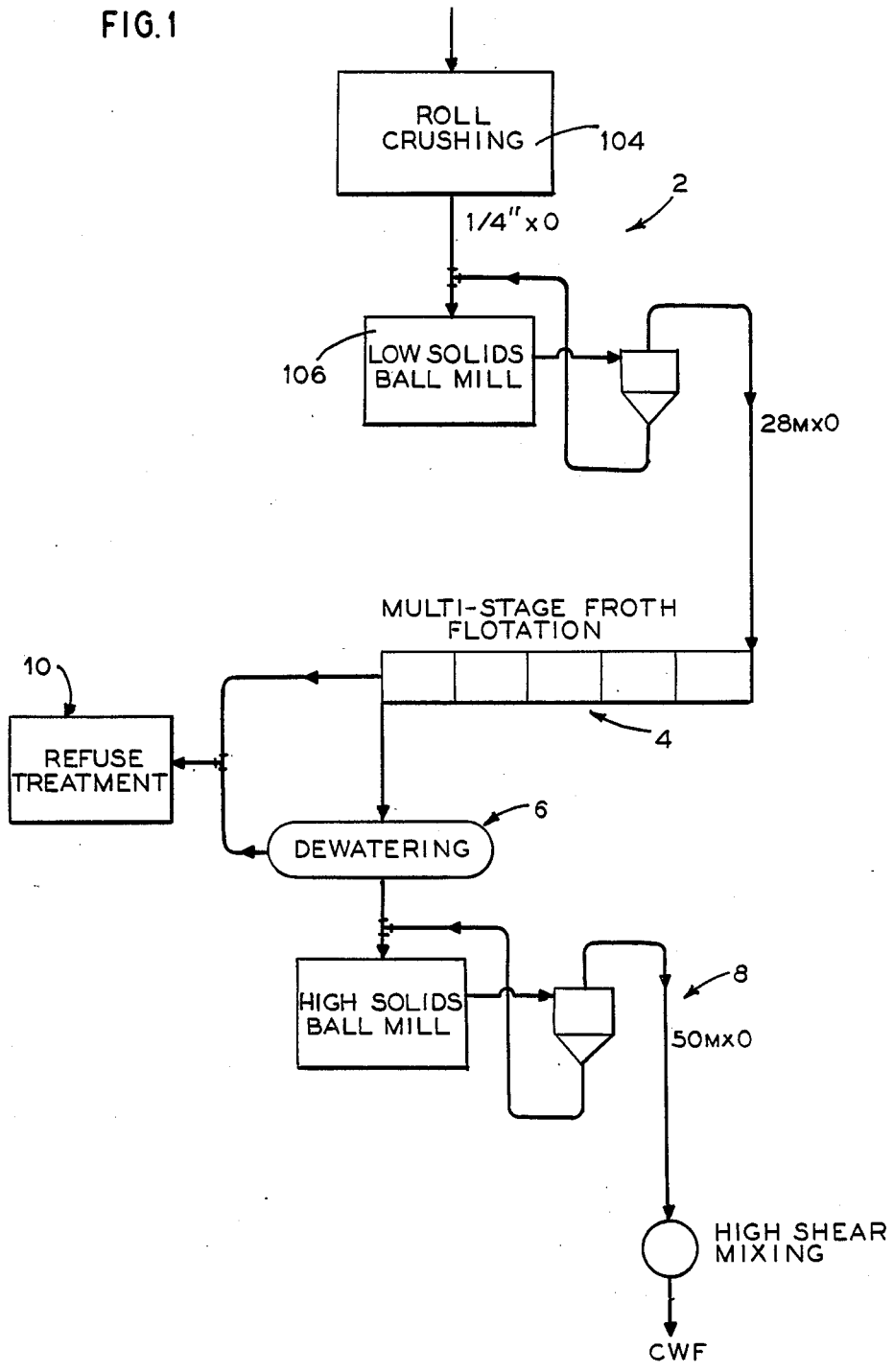
FIG. 1 is a block diagram showing an apparatus in accordance with the invention for practicing the inventive method.

Referring to the drawings, the invention embodied in FIG. 1 is an apparatus and process for producing coal-water fuel.

The invention includes six functional circuits. These are the crushing and primary grinding circuit generally designated 2, a froth flotation circuit for ash and pyritic sulfur reduction designated 4, a product dewatering circuit designated 6 for establishing a selected solids content, a slurry preparation circuit designated 8 for producing a desirable particle size distribution in the fuel, and a refuse dewatering and water clarification circuit designated 10 for treating refuse from one or more of the other functional circuits and for clarifying water from those circuits and for reuse in the CWF production process.

Figure 2:
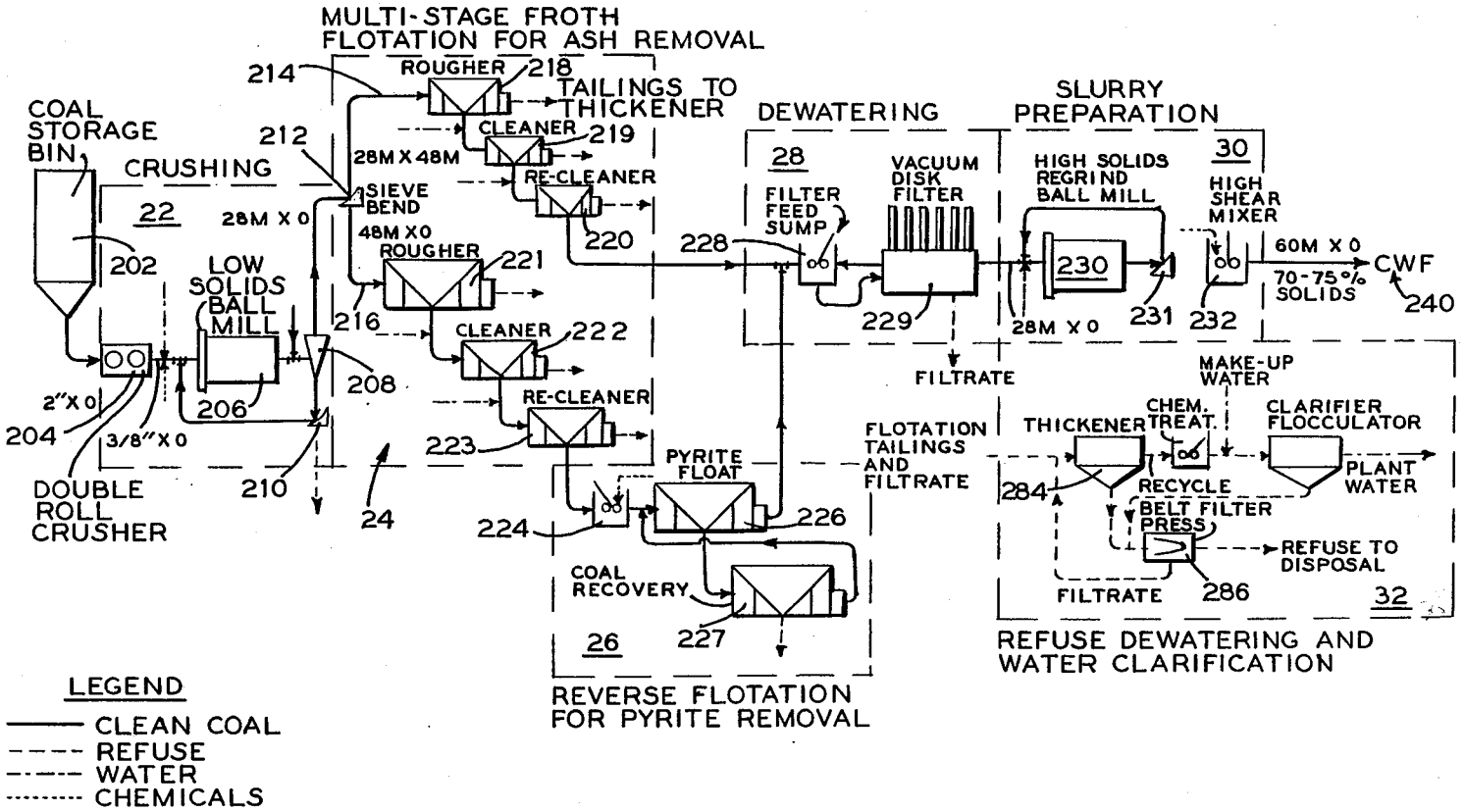
FIG. 2 is a schematic illustration of an alternate embodiment of the invention.

FIG. 2 shows another embodiment of the invention with a crushing circuit 22, a froth flotation circuit 24, a reverse flotation circuit 26, a dewatering circuit 28, a slurry preparation circuit 30 and a refuse treatment circuit 32.

The separate functional circuits of the invention will now be described individually with reference to FIGS. 1 and 2.

Crushing and Primary Grinding

Raw coal arriving at a plant is sampled and stored in separate piles (not shown) if desired. Coal would be moved from the piles to one of several raw coal storage bins one of which is shown at 202 in FIG. 2. Separate feeders on each bin would permit blending of coals ahead of the process to meet specific feed requirements.

Initial size reduction of the nominal 3 to 5 inches×0, 10–20% ash raw coal will be accomplished using a impact type crusher 104 in FIG. 1 or 204 in FIG. 2. Several crushers of this type are commercially available. Hammermill and cage mill designs are potentially attractive alternatives. The crushers 104 or 204 are sized and operated to produce a ¾ inch×0 product for subsequent processing. An overall reduction ratio of approximately 6:1 is required. Staging of the crushers may be necessary to achieve this reduction ratio. The maximum particle size of the crushed product may be adjusted to meet the specific needs of the particular coal being processed.

In FIG. 1 the crushed coal flows by gravity to the primary wet grinding operation at 106. This wet grinding operation serves several important functions: (1) it ensures a consistent coal particle size distribution to downstream processes independent of the raw coal size distribution, (2) it creates highly active, freshly ground coal surface sites for subsequent froth flotation processing, (3) it inhibits surface oxidation of the newly produced active coal sites, and (4) it acts as an efficient wetting/mixing/conditioning device.

Conventional wet ball mills (206 in FIG. 2) or rod mills are potential alternatives for this unit operation. Both of these devices are capable of producing a 28 mesh×0 product from the ¾ inch×0 feed, corresponding to a reduction ratio of 33:1. Either mill would be operated at approximately 50% solids. The mill operating conditions and final product size distribution will be determined by the characteristics of the coal being processed.

Two different grinding circuit designs have been considered. The first (FIG. 2) is a conventional closed circuit wet ball milling process. In this mode of operation, the mill product is pumped to a hydrocyclone classifier 208. Underflow from the cyclone, containing oversized coal and fine pyrite particles (cyclone separation is based on particle mass), is passed over a sieve bend 210. The sieve bend overproduct is returned to the mill 206 for regrinding, and the pyrite enriched underproduct is directed to a refuse thickener 284 in circuit 32. Cyclone overflow is directed to the froth flotation circuit 24. This type of circuit may be useful for coals containing a relatively high amount of coarse pyrite contamination.

Open circuit rod milling is a second alternative (not shown). The rod mill alternative would be expected to provide a narrower size distribution, i.e. fewer ultrafine particles, while still producing the minus 28 mesh product. Reducing the amount of ultrafine particles should improve the performance of the froth flotation circuit.

The minus 28 mesh product from the grinding circuit 22 may be directed to either the beneficiation circuit 24, 26 or possibly to a vacuum filtration system 229 for dewatering in circuit 28 as feed to the slurry preparation circuit 30. The latter option will be used if the coal is of sufficient quality to meet customer specifications without further ash or sulfur reduction. This option may be used if a pre-cleaned coal is chosen for feed to the process.

Conventional Froth Flotation

The performance of the flotation process is dependent to some extent on the distribution of particle sizes present in the feed, as are all beneficiation techniques. Flotation kinetics and optimal cell operating conditions are particle size dependent. Therefore, close control of particle size may be required to improve selectivity and, hence, ash rejection and coal recovery. The flotation feed may be split into coarse and fine fractions depending on the characteristics of the coal being processed. This choice involves determination of the feed size distribution, to predict the mass flows to each circuit, and analysis of the flotation behavior of individual size fractions. Note that the grinding mill may be controlled to adjust the product size distribution.

Referring to FIG. 2, the grinding circuit product can be classified using a two-stage sieve bend arrangement 212. Provided the grinding mill has been adjusted to produce a consistent minus 28 mesh product, the first stage sieve bend is designed to separate the feed stream into 28×48 mesh at 214 (or 28×65) and minus 48 mesh (or minus 65 mesh) products at 216. The actual size differentiation will be determined by the characteristics of the coal being processed. Screening inefficiencies will result in some carry-over of fine material with the sieve bend overproduct. This overproduct can be passed over a second sieve bend (not shown, but again designed for a 48 or 65 mesh cut) to improve removal of the fine material. Water sprays are needed on this second sieve bend to improve screening efficiency. The coarse and fine fractions are collected in separate sumps for pumping to the appropriate multistage flotation circuit.

Multistage flotation involves retreating the froth product for further ash and sulfur reduction. Typically, at least one flotation stage 218–223 would be necessary. The actual number of stages required depends on the measured froth product quality and charactistics of the coal being processed. Generally, each successive stage is operated to provide an increasingly higher quality product. Physically, the stages are located at different levels in the plant so that the froth product from one stage may be gravity fed to the next. Note that no recycling of the high ash, high sulfur tailings products is intended. These products are directed to the refuse dewatering and water clarification circuits 32 (dash lines).

Each stage consists of one or more individual flotation cells. The froth from each cell may be collected separately so that product quality can be closely monitored and controlled. If necessry, the froth may be sprayed with water to remove any loosely held middlings particles. Flotation reagents will be added directly to the flotation cells or to a conditioning tank ahead of the cells. An alcohol or glycol frother, such as methyl amyl alcohol (or methyl isobutyl carbinol), will be used to produce a selective, stable froth. If necessary, fuel oil (No. 2 or No. 6) or alternative flotation promoters will be added to improve coal recovery. The actual reagent package required will be coal specific and must be identified by laboratory research for each application of the process.

Separation of the grinding circuit product into coarse and fine streams may or may not be required, depending on the charactistics of the coal being processed.

Following size classification of the grinding circuit product, the solids content of the coarse fraction is too high for effective flotation since most of the water passes through the sieve bend with the fine particles. Plant recirculating water (dot-dash lines), from the water clarification operation 32, is added to the coarse coal sump to dilute the feed to the rougher flotation unit to approximately 10% solids. Low reagent dosages (0.1 to 0.5 pounds of reagent/ton of coal) and relatively mild aeration (0.05 to 0.20 cfm per cubic foot of cell volume) are used in the first two rougher cells 218, to increase selectivity. The froth products from these cells may or may not require retreatment in the cleaner stage 219. Additionally, chemical reagents may be added to the remainder of the rougher cells to float as much material as possible. These froth products may be directed to coarse-cleaner flotation 219. The quality of the froth product from the last rougher cell may be substantially lower than that from previous cells. This low grade middlings product may be passed over a sieve bend, (not shown in the figure) with the overproduct returned to the crushing circuit 22 for regrinding and the underproduct directed to the refuse dewatering circuit 32.

The appropriate froths from the rougher stage 218 may be fed to the cleaner stage 219. Water is added to the rougher cell froth launders 218 to dilute the feed to the cleaner stage 219 to approximately 10% solids by weight. The purpose of this stage is to produce a final clean coal product in terms of ash and sulfur content and carbon yield. Pyrite depressing reagents, such as CaO, $KMnO_4$, or $K_2Cr_2O_7$, may be added to the flotation cells to improve sulfur reduction. The coarse cleaner froth products flow to the vacuum filter feed sump 228. As in the rougher stage, the froth from the last cell may need to be screened and returned to the grinding mill 206. The cleaner tailings are directed to the refuse dewatering circuit 32.

The underflow from the classification of the grinding circuit product on line 216 (typically 48 mesh×0 or 65 mesh×0) flows directly to the fine coal rougher flotation feed sump. The feed solids content of the fine coal rougher circuit 221 is less than that of the coarse rougher 218, probably on the order of 5 to 7% solids. This lower solids content is a result of most of the water from the grinding circuit product (at 50% solids) passing through the sieve bend 212 with the fine coal. It would be impractical to include a dewatering device at this location in the process. Therefore, the fine coal rougher flotation unit 221 must handle all of this water. The dilute feed is beneficial to flotation performance, but may increase the size or number of flotation cells required.

If necessary, the froth products from all of the fine rougher cells 221 may be cleaned at 222 and then recleaned at 223 at about 10% solids by weight to remove ash and as much sulfur as possible. The actual number of flotation stages will be dependent on the characteristics of the coal being processed. The sulfur reduction at this point will essentially be limited to particle sizes between 48 and 150 mesh. The tailings from all of the stages are directed to the refuse disposal and water treatment circuit 32 for dewatering and water clarification.

Multiple stage flotation of the fine coal produces an acceptable clean coal product in all sizes in terms of ash content at maximum carbon recovery. Some minus 100 mesh pyritic sulfur may be present in the final froth product leaving the recleaner 223. This product can then be directed to the fine pyrite flotation circuit 26.

Pyrite (or Reverse) Flotation

The reverse flotation circuit 26 is operated to reject fine pyritic sulfur and maximize fine coal recovery. reverse flotation is not applicable for ash reduction, nor is it efficient for separation of plus 100 mesh pyrite. Consequently, the reverse flotation circuit must be preceded by conventional coal flotation in circuit 24.

The inventive process includes a two-stage 226, 227 reverse flotation circuit for reducing the sulfur content of the fine coal froth. This froth product, at 20% to 25% solids by weight, must be conditioned to prepare the particle surfaces for coal depression and pyrite flotation. Approximately 0.4 to 0.7 pounds of depressant reagent/ton of coal and 0.4 to 0.7 pounds of pyrite flotation reagent/ton of coal are added to a conditioning tank 224 (dotted line). The actual reagents and reagent quantities used are characteristic of the particular coal being processed. Additionally, the tank contents must be adjusted to a pH of 4. This acidic condition helps to remove certain chemical groups from the pyrite particle surfaces rendering them more hydrophobic. Dilution to 15% to 20% solids may be required prior to feeding this conditioned slurry to the rougher reverse flotation unit 226.

Previous experience has indicated that the rougher reverse flotation stage 226 produces a high sulfur froth and a corresponding low sulfur clean coal tailings product. The reverse flotation rougher tails are directed to the clean coal dewatering circuit 28. However, the froth from the last few cells in the rougher unit 226 may contain excessive amounts of carbon. To recover this carbon, the rougher froth will be retreated in a cleaner stage 227.

The high sulfur froth product from the reverse flotation cleaner stage 227 may be passed over a sieve bend to (not shown) remove coarse coal/pyrite particles containing a significant amount of carbon. The overproduct would then be directed to the crushing circuit 22 for regrinding and liberation of the pyrite particles. The sieve bend underproduct would flow to the refuse disposal and water treatment circuit 32 for dewatering and water clarification.

The reverse flotation cleaner tails may be considered a coal middlings product which can be returned to the reverse flotation rougher feed 226. This product could also be sent back to the crushing circuit 22 for regrinding.

Clean Coal Dewatering

The clean coal dewatering circuit 28 must be designed to provide a closely controlled, high solids content feed to the slurry preparation circuit 30. The approximately 25% solids feed to the disc filter 229 must be dewatered to approximately 75% to 78% solids. This feed is comprised of the conventional coal flotation froth products and the reverse flotation tailing products. Should the beneficiation circuits 24 and 26 be by-passed, the crushing circuit 22 product will be sent directly to the disc filter feed sump 228.

The filter feed sump 228 serves as a storage and mix tank for the filter feed. Laboratory experience indicates that the froth from the flotation circuit 24 products should break up fairly easily under mild agitation. A consistent filter feed at maximum solids concentration aids filter performance.

To maintain optimum filter performance, a filter vacuum must be maintained at a constant, high level. Dual-stage vacuum pumps are required to maintain vacuum with ground coals of varying filter cake porosity. A second means of maintaining a high vacuum is to ensure that the filter tub remains full. Filter rotation speed and, hence, production of filter cake, is controlled to match the tonnage of clean coal product from the froth flotation curcuits. However, coal flotation products would be pumped to the filter at a rate higher than the operating filter capacity so that a steady overflow back to the filter feed sump 228 is provided. This overflow results in a constant flotation product level in the filter tub of the vacuum disk filter 229. A snap blow feature should be included for a good cake discharge.

The importance of the dewatering circuit 28 to coal-water fuel production cannot be overemphasized. The solids content of the dewatered product must be kept as high as possible to provide some degree of flexibility in the subsequent slurry production circuit 30.

Coal-Water Slurry Preparation

The slurry preparation circuit 30 consists of a second grinding step at 230 to produce the optimal particle size distribution. Slurry rheology is controlled in two sets of high sheet mixer tanks 232 in series; the first for viscosity control, the second for controlling slurry stability. Note that the slurry preparation system 30, like the flotation systems 24 and 26, includes the necessary chemical handling, storage, and metering equipment (not shown).

The dewatered, clean coal filter cake from the vacuum disc filter 229 falls directly onto a belt conveyor through plastic lined chutes. Conveyor belt scales are used to provide an accurate measurement of the feed rate to the grinding mill 230. The cake drops into a ball mill screw feeder where a portion of the chemical dispersant reagent, pH adjustment chemicals, and any required dilution water will also be added (dotted line). The regrind ball mill 230 is operated in a high solids mode (70% to 78% solids by weight). Consistent control of the product particle size distribution is achieved by controlling the viscosity of the mill coal-water slurry via the addition of chemical based disperants. The regrind ball mill operating variables, including ball size distribution, ball charge loading, and mill speed, are chosen to maximize product throughput and minimize power consumption. Since the ball mill is a very efficient mixer, the need for sophisticated solids takedown mechanical mixers is eliminated.

For some coals, high solids ball milling may not efficiently produce a sufficient amount of very fine particles to maintain the correct rhelogical and stability properties of the slurry. To correct this situation, a portion of the vacuum filter cake may be directed instead to a stirred ball mill (not shown). Enough water would have to be added to dilute the stirred ball mill feed to 50% to 60% solids. The product from this ultrafine grinding device would then be added to the ball mill feed to provide the needed amount of fine particles. It is important to note that the solids content in the ball mill 230 must be maintained at a high level, about 70% solids. If the amount of stirred ball mill product is sufficient to significantly reduce the overall slurry solids content in the ball mill, it may be necessary to return this product back to the disc filter 229 rather than feed it directly to the ball mill 230.

The semi-finished coal-water slurry from the mill will have a viscosity ranging from 1500 to 4000 centipoise and a solids content of 70% to 75%. This slurry is pumped to a viscosity process blend tank (not shown) equipped with low speed, high efficiency impeller mixers where the remaining chemical based dispersants are added to lower the slurry viscosity to approximately 500 to 2000 centipoise.

The product from the viscosity process blend tank (not shown) is pumped to a high frequency vibrating screen 231 for removal of oversize material (+48 mesh particles). The amount of oversize material is projected to be less than 3% by weight and will be recycled to the ball mill 230 feed for additional grinding. This vibrating screen is an external classifier which forms a closed grinding circuit to provide control of the maximum particle size.

The vibrating screen 231 underflow will flow by gravity to a stabilizer process blend tank 232 for final slurry preparation. A chemical stabilizer to inhibit particle settling and caustic chemical for pH adjustment may be added to the blend tank to obtain final product quality. All of the chemicals used in slurry preparation are commercially available, environmentally acceptable, and can be readily obtained from existing chemical suppliers.

The final coal-water fuel (CWF) product at 240, is pumped from the stabilizer process blend tank to storage tanks. These storage tanks are insulated and equipped with mixers to ensure product homogeneity. The product can be transferred from the storage tanks for shipment by tanker truck, rail, or barge.

Refuse Dewatering and Water Clarification

The refuse dewatering and water clarification circuit 32 is designed to prepare the plant refuse for environmentally acceptable disposal and to provide clean process water for reuse in the plant. Any contamination of recirculating water can adversely affect product quality. Therefore, proper performance of this system must be assured to maintain overall process performance and product quality.

All of the process rejects, including tailings from the conventional froth flotation circuits 24, froth from the rougher reverse flotation operation 26, and filtrate from the vacuum disc filter 229, flow by gravity to a static thickener 284. The thickener provides a fairly quiescent environment in which solid particles may settle out, leaving a clarified water layer. This thickener overflow is returned to the plant water supply system for recycling to the process. Fresh makeup water must also be added to the water supply system.

Thickener underflow, at approximately 25% to 30% solids by weight, is pumped to a belt filter press 286 for further dewatering. The belt filter press was selected because of its ability to handle ultra fines and clay slimes. The belt press filtrate is returned to the static thickener 284. The dewatered refuse filter cake, 60% to 80% solids by weight, is transferred to an external storage pile by a belt conveyor for subsequent landfill disposal.

To protect the CWF production process against shutdown in the event of an upset in any portion of the refuse dewatering and water clarification circuit, several ponds will be constructed at the plant site. The ponds also provide storage for excess plant water, supply process makeup water on a continuing or intermittent basis, and provide a receiving basin for thickener drainage during scheduled and unscheduled plant shutdowns.

The inventive process offers several advantages for both slurry production and coal beneficiation. These advantages may be broadly categorized as resulting from the modular design or attributed to operating flexibility.

The invention evolved through consideration of distinct unit operations to address specific functional needs such as ash and pyritic sulfur liberation, ash reduction, pyritic sulfur removal, dewatering, and slurry preparation. This approach resulted in a modular structure which should permit:

- Optimal management of individual unit operations.
- Sampling between modules to pinpoint sources of specific performance problems.
- Addition of parallel units to increase plant capacity.
- Substitution of advanced unit operations as they are developed (coal beneficiation in particular).

The invention has been designed to permit a high degree of operating flexibility to respond to variations in feed coal quality and customer product specifications. A few examples of flexibility include:

- Control of the feed size distribution to the initial milling operation to respond to variation in the coal breakage parameters.
- Control of the size distribution to the beneficiation process dependent on the degree of grinding required for ash and pyrite liberation.
- Ability to by-pass the benefication circuit completely if the raw coal quality satisfies the customer's specifications. This would also allow the refuse filtration system to be shut down.
- Ability to consolidate the split feed froth flotation operation.
- Ability to by-pass the sulfur reduction portion of the beneficiation circuit for low sulfur, high ash feed coals.

The inventive CWF production process is unique in that it specifically addresses the problem of fine particle pyritic sulfur removal.

Test Results

The feasibility of the basic concept has been demonstrated in the laboratory using several coals. The coal samples were first ground in a laboratory batch rod mill, cleaned by multiple stage froth flotation with a laboratory flotation machine, dewatered by vacuum filtration, and ground in a laboratory batch ball mill. Representative test results for two coal seams, the Upper Freeport seam coal and the Pittsburgh seam coal, are presented here. The individual operations will be discussed sequentially.

Rod Milling

Figure 3:
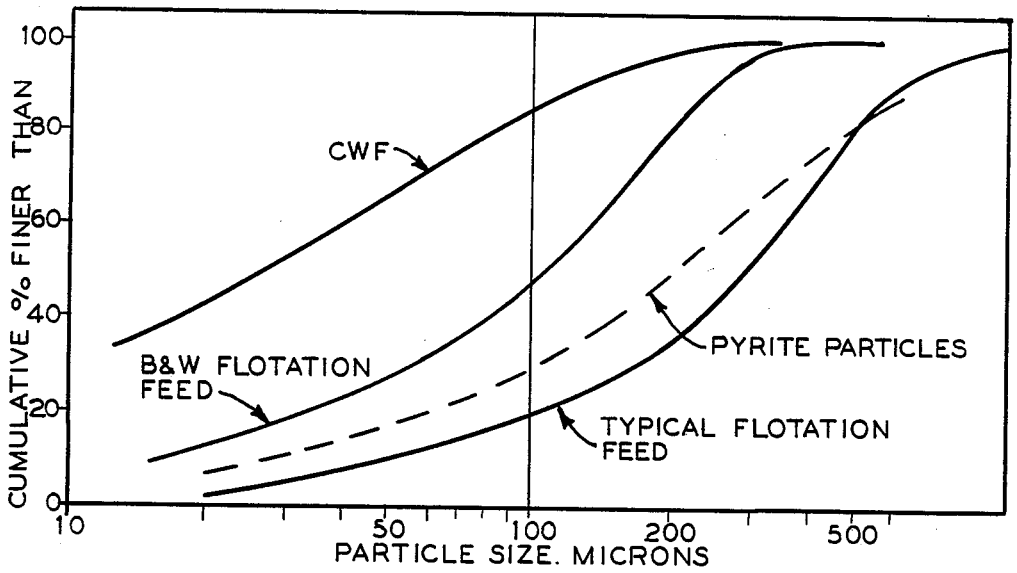
FIG. 3 is a graph showing the particle size distribution of the flotation feed produced by rod milling Upper Freeport coal.
Figure 4:
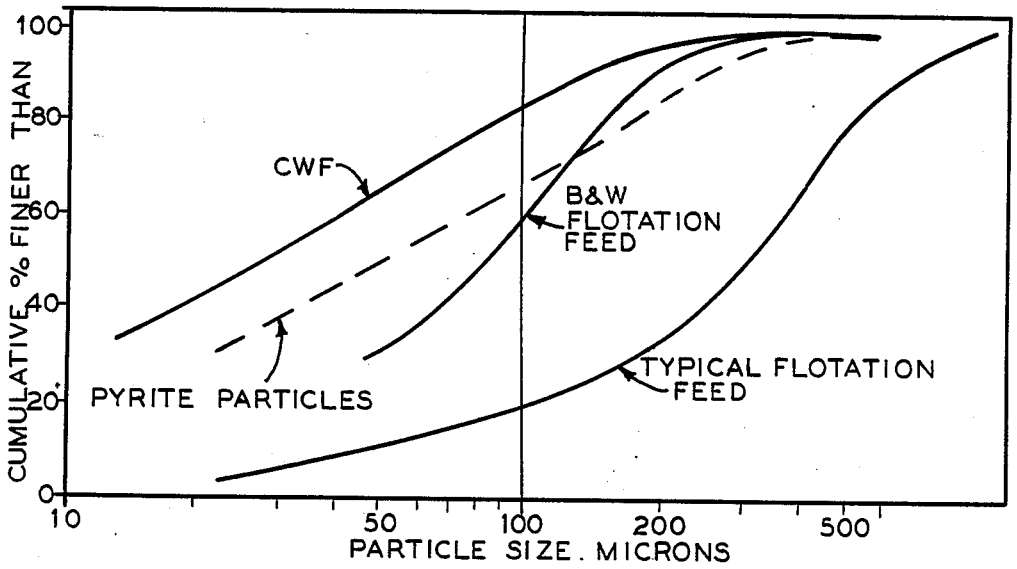
FIG. 4 is a graph showing the particle size distribution of the flotation feed produced by rod milling Pittsburgh seam coal.

The degree of primary grinding required for liberation of the mineral matter and pyritic sulfur contaminants from the coal matrix is dependent on the nature and distribution of these contaminants. The contaminants in the Pittsburgh seam coal are more finely disseminated than those characteristic of the Upper Freeport seam coal. Therefore, the Pittsburgh seam coal must be ground finer to attain the desired liberation. The size distribution of the final coal-water fuel product represents a limit to the amount of grinding permitted at this stage. Flotation feed particle size distributions produced by rod milling in the laboratory are presented in FIG. 3 and FIG. 4.

Froth Flotation

The froth flotation circuits examined included multiple stage coal flotation and reverse flotation. Significant reductions in the ash and sulfur contents of the feed were achieved with high recoveries of the combustible material as shown in the following table.

TABLE

FROTH FLOTATION CIRCUIT PERFORMANCE

| PERCENT | PITTSBURGH SEAM COAL | UPPER FREEPORT SEAM COAL |
|---|---|---|
| ASH IN FEED | 6.08 | 9.17 |
| SULFUR IN FEED | 1.32 | 1.74 |
| ASH IN PRODUCT | 3.45 | 5.16 |
| SULFUR IN PRODUCT | 1.07 | 0.76 |

TABLE-continued

| FROTH FLOTATION CIRCUIT PERFORMANCE | | |
|---|---|---|
| PERCENT | PITTSBURGH SEAM COAL | UPPER FREEPORT SEAM COAL |
| BTU RECOVERY | 85 | 92 |

Vacuum Filtration

The froth products from the flotation testing were dewatered using a filter leaf test kit. A range of filtration cycle characteristics and vacuum pressures were investigated. The tests indicated that dewatered cake solids contents ranging from 68% to 77% solids could be obtained from the fine particle flotation products.

CWF Preparation

The dewatered froth products were mixed with chemical reagents and ground in a laboratory batch ball mill to produce stable coal water slurries. The slurry chracteristics are indicated in the following table:

| | PITTSBURGH SEAM COAL | UPPER FREEPORT SEAM COAL |
|---|---|---|
| Solids Content-% | 70.6 | 73.4 |
| Slurry Viscosity - $C_p$ at 100 reciprocal sec. | 870 | 850 |

Figure 5:
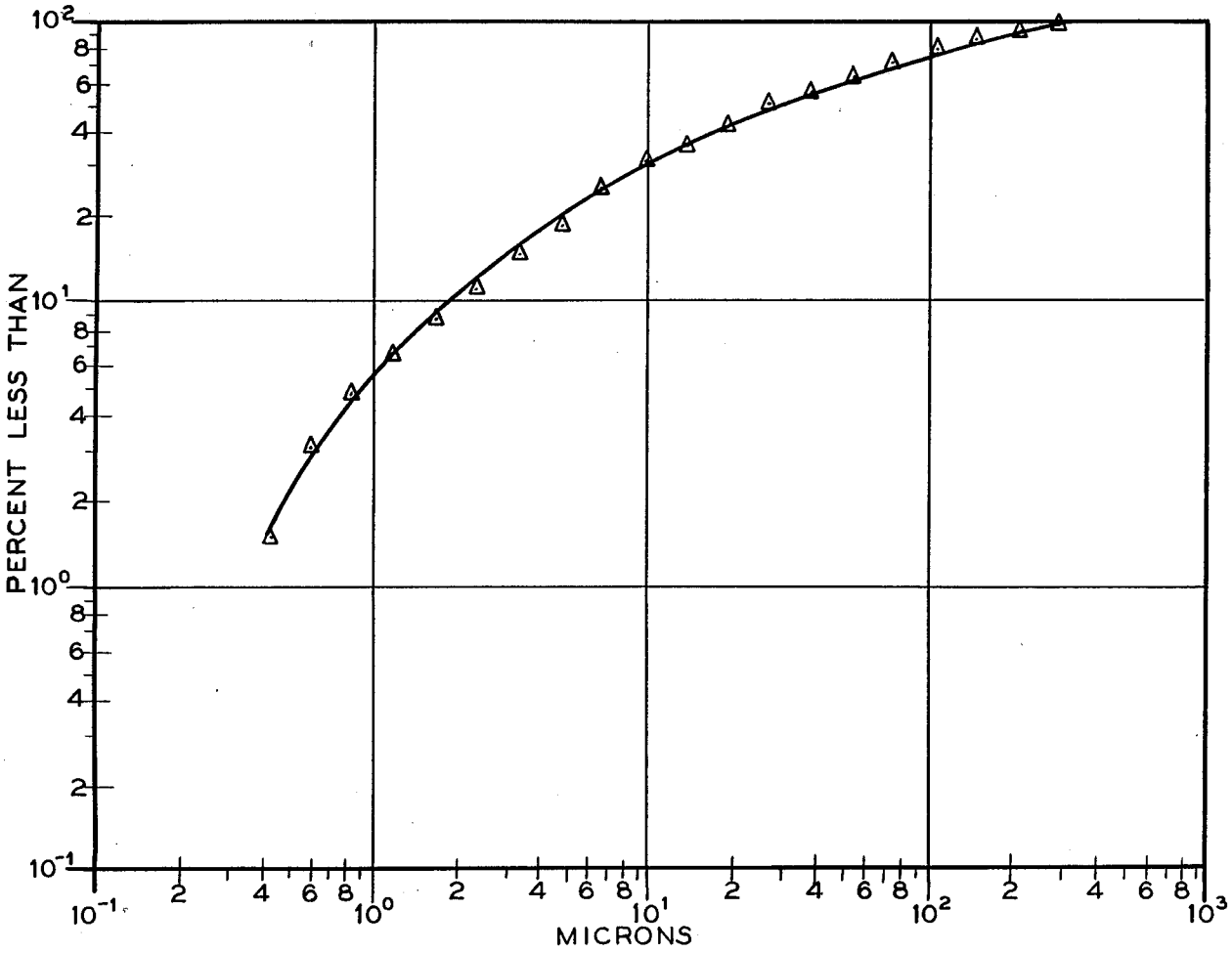
FIG. 5 is a graph showing the final CWF size distribution for the Upper Freeport seam coal test.
Figure 6:
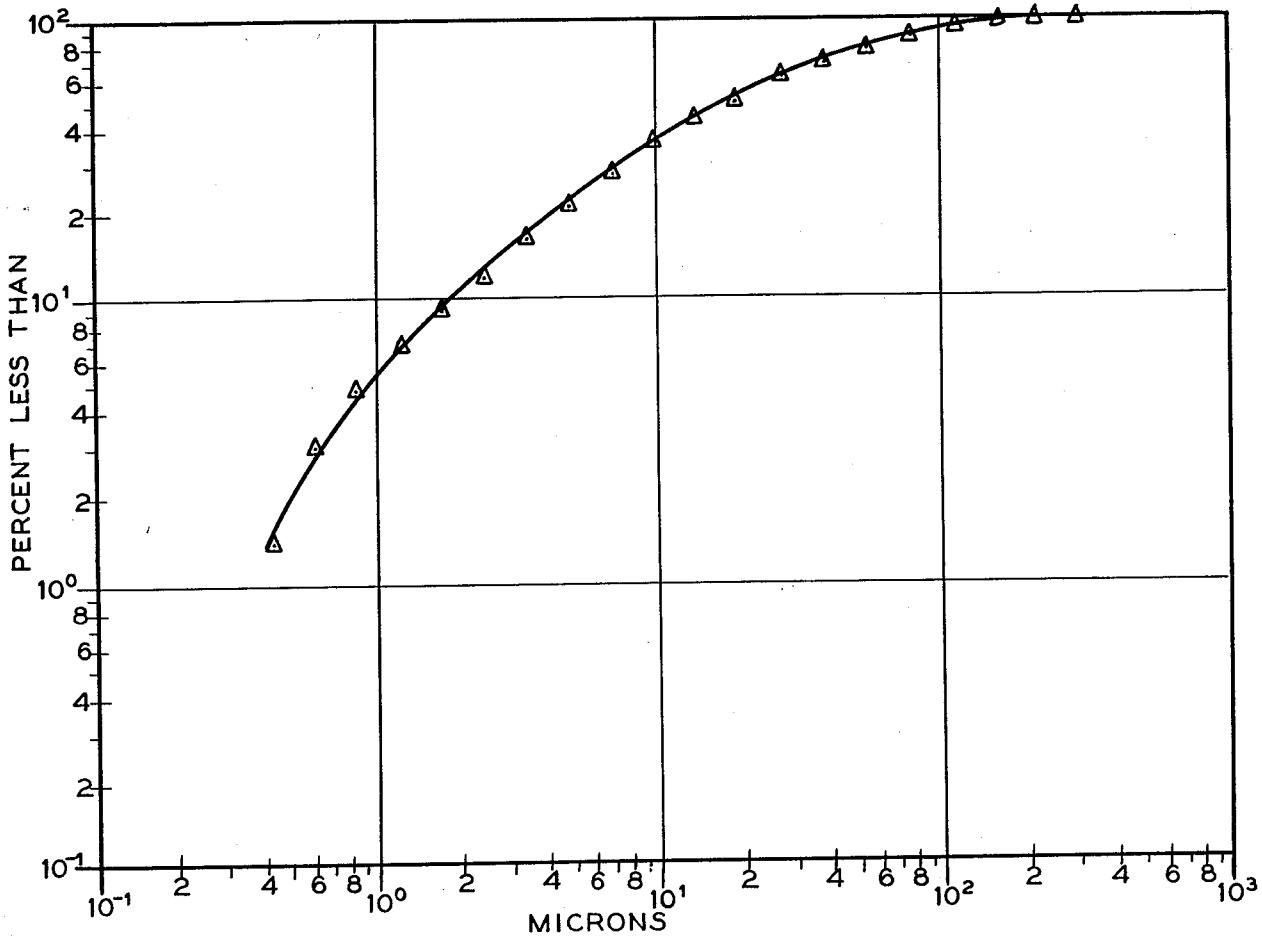
FIG. 6 is a graph showing the final CWF size distribution for the Pittsburgh seam coal test.

The particle size distributions of the slurries are presented in FIGS. 5 and 6.

While specific embodiments of the invention have been shown and described in detail to illustrate the application of the principles of the invention, it will be understood that the invention may be embodied otherwise without departing from such principles.

What is claimed is:

1. A method of producing coal-water fuel from raw coal, comprising:

crushing the raw coal for initial size reduction of the coal;

grinding the crushed coal in a primary grinding mill;

then adding water and chemicals to the ground coal in a froth flotation process for removing ash and coarse pyritic sulphur from the ground coal to form a reduced-ash and reduced-sulphur coal;

next adding water and chemicals to the reduced-ash reduced-sulphur coal in a reverse flotation process for removing fine pyritic sulphur from the coal;

dewatering the coal from the froth flotation and reverse flotation processes; and preparing a slurry from the dewatered coal which has a selected size distribution, the slurry being usable as coal-water fuel.

2. A method according to claim 1 including crushing the coal to produce a $\frac{3}{4}$ inch×0 crushed coal and grinding the $\frac{3}{4}$ inch×0 coal in the primary grinding mill to form 28 mesh×0 ground coal.

3. A method according to claim 2, including primary grinding of the coal using a closed circuit wet ball milling process to form the ground product, hydrocyclone classification of the ground coal to form an overflow and an underflow, directing the overflow to the froth flotation process, directing the underflow to a sieve bend to produce an overproduct and an underproduct, the overproduct being returned to the wet ball milling process and the underproduct being supplied to a refuse thickener.

4. A method according to claim 2, including primary grinding of the coal using an open circuit rod milling process to produce the 28 mesh×0 ground coal.

5. A method according to claim 2, wherein a low ash and low pyritic sulphur raw coal is used, including passing the 28 mesh×0 ground product directly from the primary grinding to the dewatering step.

6. A method according to claim 1, including executing the froth flotation process in at least one stage including an initial rougher flotation stage, a cleaner flotation stage and a re-cleaner flotation stage.

7. A method according to claim 6, including providing two parallel froth flotation circuits, each having at least one stage including a rougher, a cleaner and re-cleaner flotation stage, and including passing the granular product through a sieve bend before it reaches the froth flotation stages, the overproduct of the sieve bend being supplied to one of the flotation circuits and the underproduct of the sieve bend being supplied to the other flotation circuit.

8. A method according to claim 1, wherein the dewatering step includes a filter feed sump and a vacuum disk filter.

9. A method according to claim 8, wherein preparing the slurry includes a high solid regrind ball mill for further particle size reduction and optimum particle size distribution, a vibrating screen for maximum particle size control, and at least one high shear mixing tank for final slurry preparation.

10. A method according to claim 1, including accumulating refuse, rejects and filtrate from the various system unit operations in a static thickener to separate water and solids, pressing the solids to form a disposable refuse product and treating the separated water for reuse in the system.

11. A method according to claim 1 wherein the chemicals added in the reverse flotation process step comprise a coal depressant reagent and a pyrite flotation reagent.

12. A method according to claim 1 wherein the grinding step comprises grinding the crushed coal to produce a size of no greater than plus 100 mesh pyrite.

13. An apparatus for producing coal-water fuel from raw coal comprising:

a crusher for receiving the raw coal and crushing it;

a primary grinder connected to said crusher for receiving and grinding the crushed raw coal;

froth flotation means connected to said primary grinder for receiving crushed and ground raw coal from the primary grinder to form a reduced-ash and reduced-pyritic sulphur coal;

reverse flotation means connected to said froth flotation means for receiving the reduced-ash reduced-pyritic sulphur coal for further reduction of pyritic sulphur in the coal;

dewatering means connected to said flotation means for dewatering the reduced-ash and reduced-pyritic sulphur coal, and slurry forming means connected to said dewatering means for receiving dewatered coal from the dewatering means and forming a slurry thereof which can be used as coal-water fuel.

14. An apparatus according to claim 13, including refuse dewatering and water clarification means connected to said flotation means and to said dewatering means for refuse disposal and water reuse in the apparatus.

15. An apparatus according to claim 14, wherein said primary grinder comprises a closed circuit wet ball mill.

16. An apparatus according to claim 14, wherein said primary grinder comprises an open circuit rod mill.

17. An apparatus according to claim 14, wherein said froth flotation means comprises at least one froth flotation stage.

18. An apparatus according to claim 17, wherein said froth flotation means includes a sieve bend which receives the output of the primary grinder and splits the flotation feed into coarse and fine fractions, in parallel circuits.

19. An apparatus according to claim 15, wherein said dewatering means is connected to an output of said froth flotation stages.

20. An apparatus according to claim 13, wherein said dewatering means comprises a filter feed sump and a vacuum disk filter.

21. An apparatus according to claim 13, wherein said slurry preparation means comprises a regrind ball mill, screen classifier, and at least one mixing tank.

22. An apparatus according to claim 14 wherein said refuse dewatering and water clarification means comprises a static thickener to separate solids and water, the solids consisting of the plant refuse including refuse from the froth flotation means for compacting and disposal, and the liquids including filtrate from the dewatering means for treatment and reuse.

* * * * *